United States Patent [19]

Sawdon

[11] Patent Number: 4,923,192

[45] Date of Patent: May 8, 1990

[54] PORTABLE EXERCISE KIT

[76] Inventor: Floyd Sawdon, 641 East Aitken Rd., Applegate, Mich. 48401

[21] Appl. No.: 277,316

[22] Filed: Nov. 29, 1988

Related U.S. Application Data

[63] Continuation-in-part of Ser. No. 150,192, Jan. 29, 1988, abandoned.

[51] Int. Cl.[5] ..... A63B 23/04

[52] U.S. Cl. ..... 272/70; 272/96; 272/117

[58] Field of Search ..... 272/65, 69, 70, 96, 272/109, 119, 122, DIG. 9, 117, 93; 52/314, 746

[56] References Cited

U.S. PATENT DOCUMENTS

| | | | |
|---|---|---|---|
| 2,130,911 | 9/1938 | Tevnon | 52/314 X |
| 2,253,996 | 8/1941 | Bechman | 272/70 |
| 2,842,365 | 7/1958 | Kelley | 272/70 X |
| 3,641,601 | 2/1972 | Sieg | 272/70 X |
| 3,863,272 | 2/1975 | Giuille | 36/12 X |
| 4,159,111 | 6/1979 | Lowth | 272/96 |
| 4,159,826 | 7/1979 | Hancock | 272/70 X |
| 4,253,661 | 3/1981 | Russell | 272/70 X |
| 4,575,074 | 3/1986 | Damratoski | 272/119 |
| 4,590,726 | 5/1986 | Salazak | 52/314 |
| 4,777,743 | 10/1988 | Roehrig, Jr. | 272/96 |
| 4,779,862 | 10/1988 | Keppler | 272/70 |

*Primary Examiner*—Robert W. Bahr

*Attorney, Agent, or Firm*—Irving M. Weiner; Robert M. Petrik; Joseph P. Carrier

[57] ABSTRACT

A portable exercise lit including a pad and variable capacity weights. The pad is placed in front of a chair and has a slippery side. The person's feet are moved back and forth on the pad in a motion similar to cross-country skiing. The person may wear socks or exercise shoes made of carpet. The variable capacity weights provide the user with a choice of the amount of weight to be exercised with.

2 Claims, 1 Drawing Sheet

PORTABLE EXERCISE KIT

RELATED APPLICATIONS

This application is a continuation-in-part of Ser. No. 150,192 filed Jan. 29, 1988, now abandoned.

BACKGROUND OF THE INVENTION

1. Field of the Invention

The invention relates generally to a portable exercise kit. More particularly, the present invention pertains to an exercise kit including a portable pad and variable capacity weight members for exercising.

2. Description of the Relevant Art

The relevant art is exemplified by the following U.S. Pat. Nos.

U.S. Pat. No. 3,634,895 issued in 1975 to Childers entitled "JOGGING BOARD", U.S. Pat. No. 4,590,726 issued in 1986 to Salazar entitled "DECORATIVE FACING"; U.S. Pat. No. 4,147,129 issued in 1979 to Ruplen entitled "ANIMAL PLATFORM"; U.S. Pat. No. 2,130,911 issued in 1938 to Teunon entitled "BUILDING UNIT"; and U.S. Pat. No. 4,779,862 issued in 1988 to Keppler entitled "EXERCISING APPARATUS FOR SKATERS".

The relevant art fails to show an exercise kit as disclosed in the following specification.

SUMMARY OF THE INVENTION

The present invention relates to a portable exercise kit comprising an exercise pad, shoes or socks, and variable weights. The exercise pad is provided so that one surface is slipper. The pad is placed in front of a chair and the exerciser's feet are placed thereon. While seated, the feet are then moved in a back and forth motion similar to cross-country skiing.

The present invention also provides a set of variable weights that are held in the exerciser's hands and may optionally be used while exercising the legs.

It is an object of the present invention to provide an exercise for the aged or the overweight. The person doing the exercises remains seated and can slowly work up to more repetitions are more exercises.

A further object of the present invention is to provide a method of exercising.

A further object of the present invention is to provide a means for exercising indoors or at any location where a person can sit.

Other objects, advantages, and salient features of the present invention will become apparent from the following detailed description, which, when taken in conjunction with the annexed drawings, discloses preferred embodiments of the present invention.

DETAILED DESCRIPTION OF THE PREFERRED EMBODIMENT

Figure 1:
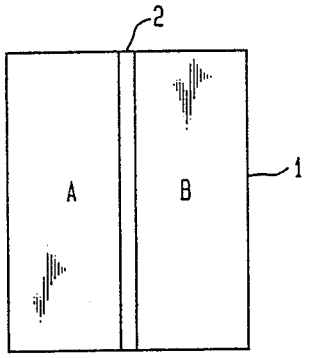
FIG. 1 illustrates a plan view of the exercise pad.

As shown in FIG. 1, an exercise pad 1 is disclosed including an upper surface with foot portions A, B. Divider 2 separates foot portions A, B. The pad 1 is preferably, but not necessarily, 19 inches by 23, and 15/16 inches by ¼ inch and comprises a piece of fiberboard known as MASONITE. The pad 1 will have a rough side 15 which is placed down, and a smooth side. The rough side being placed down allows exercises to be done without the pad 1 moving around. The divider 2 also preferably, but not necessarily, comprises a piece of fiberboard known as MOSONITE, 1 and ¼ inches by 23 and 15/16 inches by ¼ inch, with a rough side 16 which is placed upward. THe rough side 16 of the divider 2 provides a safety feature. The rough side 16 will prevent the pad 1 from slipping if the pad 1 is accidentally turned over and stepped on. The exercise pad 1 may include an optional upper layer 3 and a base member 4. The upper layer 3 can be provided as linoleum bonded to the base layer or as a glazing applied to the base layer. The glazing is preferably, but not necessarily, cement bonded adhesive. The glazing can be reapplied if it shows signs of wear as necessary to maintain a smooth surface. The base member 4 can be any suitable material such as plywood or MASONITE.

Figure 3:
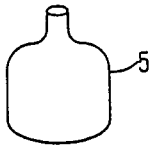
FIG. 3 illustrates a variable capacity weight of the present invention.

FIG. 3 shows a variable capacity weight 5 which can be filled with water or sand and used in addition to the exercise pad 1. The variable weight 5 may be a recloseable container. The weight is held in the user's hand, preferably, but not necessarily, up-side down, and moved in conjunction with the feet.

Figure 4:
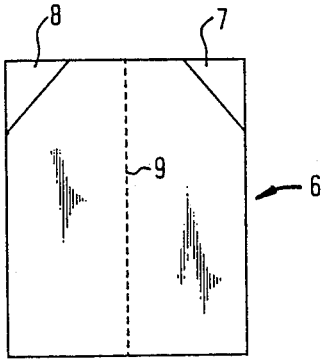
FIG. 4 illustrates a plan view of a cut-out for a pad shoe.
Figure 5:
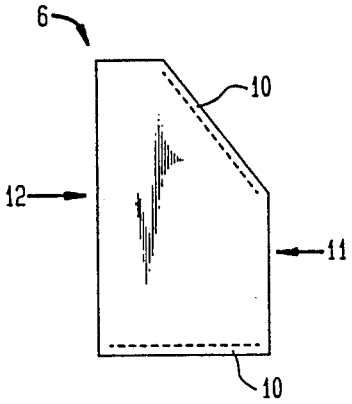
FIG. 5 illustrates a side view of the finished pad shoe.

FIGS. 4 and 5 show an exercise shoe 6 capable of being used on the exercise pad 1. Preferably, the shoe 6 is used on the pad 1. However, regular socks or stockings can also be used to do the exercises.

The shoe 6 is preferably, but not necessarily, made of carpet. A portion of carpet approximately 14 inches by 12 inches is cut out. Then, portions 7, 8 are cut off. Portions 7, 8 are 4 inches by ⅞ inches. The carpet is then folded in half along line 9 with the carpet side out, and sewn along lines 10. This leaves portion 11 open and the user's foot is inserted therein. The size of the shoes 6 may be adjusted by adjusting the sew line 10 or by further trimming the piece of carpet.

Shoes 6 or socks provides sufficient slipperiness on surface 12 to allow the user's feet to be easily moved back and forth along the pad 1.

Figure 6:
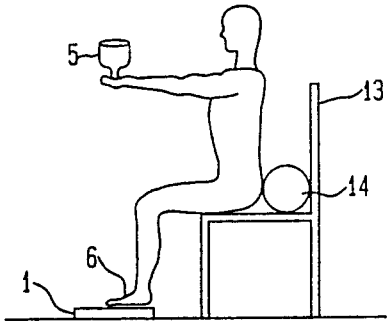
Figure 2:
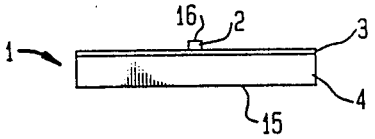
FIG. 2 illustrates a side view of the exercise pad.

As shown in FIG. 6, in use the pad 1 is placed in front of a chair 13 and the user places sufficient back support 14 behind him. Either shoe 6 or socks are placed on the exerciser's feet. The feet are placed on portions A, B and moved back and forth. A pair of variable capacity weights 5 may be used at the same time. However, preferably but not necessarily, the feet are moved back and forth for a count of forty. Then the variable weights 5 are used to exercise the arms.

When used together, the weight 5 in the right hand is moved when the right foot is moved on the pad 1. The weights 5 can either be used in a curl movement or in a "push-up" motion. The push-up motion comprises placing one's arms down by the side and lifting them 9 inches in conjunction with the foot movement.

The variable weights 5 allow the user to adjust the exercise according to the user's strength. This is especially important for elderly or impaired individuals who may not have the strength or range of motion of most people.

The pad 1 may be stored beneath a chair and used whenever a few minutes are available for exercise. The pad 1 may also be sized to fit into a normal size suitcase and taken along on trips.

Although there has been discussed what is at present what is considered to be preferred embodiments of the invention, it will be understood that various modifications and variations may be made therein, and it is intended to cover in the appended claims all such modifications as fall within the true spirit and scope of the invention.

I claim:

1. An exercise device for use by an individual who is physically impaired or elderly, comprising:

an exercise pad supporting at least one foot of a seated individual;

said pad having a length greater than the width and comprising a base member and an upper layer;

said upper layer is adhesively bonded to the entire upper surface of said base member and provides a smooth surface upon which said at least one foot slides upon;

said base member includes a rough surface on the side opposite said upper layer to prevent movement of said pad;

a divider attached to said upper layer such that said pad is divided into equal portions, each one of said equal portions accommodating one foot;

said divider extending above said upper layer and having an upper surface which prevents said pad from movement if accidentally turned over; said said pad permitting an exercise to be performed by said individual by sliding at least one foot, while wearing a sock, back and forth along said upper surface without leaving said pad surface, and said individual may exercise their arms by moving them in conjunction with said at least one foot.

2. The exercise device of claim 1, further comprising at least one sock made entirely of carpet.

* * * * *

UNITED STATES PATENT AND TRADEMARK OFFICE

CERTIFICATE OF CORRECTION

PATENT NO. : 4,923,192

DATED : May 8, 1990

INVENTOR(S) : Floyd Sawdon

It is certified that error appears in the above-identified patent and that said Letters Patent is hereby corrected as shown below:

Column 1, line 43, change "are" to --and--.

Column 2, line 8, change "MOSONITE" to --MASONITE--;
line 10, change "THe" to --The--.

Signed and Sealed this

Ninth Day of July, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,923,192

DATED : MAY 8, 1990

INVENTOR(S) : Floyd SAWDON

It is certified that error appears in the above-identified patent and that said Letters Patent is hereby corrected as shown below:

Title page:

In the Abstract

Line 1, change "lit" to --kit--.

Column 1, line 33, change "slipper" to --slippery--.

Column 4, line 9, change "said" to --and--.

Signed and Sealed this

Sixth Day of August, 1991

*Attest:*

HARRY F. MANBECK, JR.

*Attesting Officer*

*Commissioner of Patents and Trademarks*